United States Patent [19]

Stanislaw

[11] Patent Number: 4,884,324

[45] Date of Patent: Dec. 5, 1989

[54] NEEDLE LOOM HAVING IMPROVED NEEDLE BEAM GUIDE SYSTEM

[75] Inventor: Peter P. Stanislaw, Bennington, Vt.

[73] Assignee: Morrison Berkshire, Inc., North Adams, Mass.

[21] Appl. No.: 256,488

[22] Filed: Oct. 12, 1988

[51] Int. Cl.[4] ..... B22B 5/06; D04H 1/46

[52] U.S. Cl. ..... 28/107

[58] Field of Search ..... 28/107, 108, 109; 112/80.42

[56] References Cited

U.S. PATENT DOCUMENTS

| | | | |
|---|---|---|---|
| 2,930,100 | 3/1960 | Rust | 28/107 |
| 4,241,479 | 12/1980 | Dilo | 28/107 |
| 4,384,393 | 5/1983 | Asselia | 28/107 |

FOREIGN PATENT DOCUMENTS

| | | | |
|---|---|---|---|
| 2364577 | 7/1974 | Fed. Rep. of Germany | 112/80.42 |

*Primary Examiner*—Werner H. Schroeder
*Assistant Examiner*—Jodi Tokar
*Attorney, Agent, or Firm*—Lerner, David, Littenberg, Krumholz & Mentlik

[57] ABSTRACT

A needle loom is disclosed. The loom comprises a frame; a needle beam; means, including a drive shaft and crank means carried by the drive shaft and coupled to the needle beam, for reciprocating the needle beam relative to the frame; and, means, including a guide means fixedly carried by the frame and a slide means pivotally carried by the needle beam and slidable relative to the guide means, for guiding the needle beam during its reciprocating movement relative to the frame.

7 Claims, 7 Drawing Sheets

NEEDLE LOOM HAVING IMPROVED NEEDLE BEAM GUIDE SYSTEM

TECHNICAL FIELD OF THE INVENTION

The present invention relates to a needle felting machine, or needle loom, for non-woven fabrics and, more particularly, to a system for guiding reciprocating needle boards of such needle looms in a rectilinear path.

BACKGROUND OF THE INVENTION:

Needle looms typically employ a pair of spaced connecting rods to reciprocate a needle beam with respect to a web of non-woven fabric being needled by the loom. The connecting rods are journaled at one of their ends on an eccentric cam or on a crank arm carried by a drive shaft in the loom, and are journaled at the other of their ends to an upper surface of the needle beam. Guide arrangements, including guide posts fixedly carried by the needle beam and slide bushings fixedly carried by the frame of the needle loom and in engagement with the guide posts, are generally employed to confine the reciprocating motion of the needle beam to rectilinear reciprocating motion. Examples of the foregoing prior art types of needle beam guide systems for needle looms may be found in the following patents: U.S Pat. No. 3,216,082, dated Nov. 9, 1965, to R. S. Goy; U.S. Pat. No. 3,602,967, dated Sept. 7, 1971, to Zocher et al; U.S. Pat. No. 3,798,717, dated Mar. 26, 1974, to R. E. Brochetti; and, U.S. Pat. No. 3,889,326, dated June 17, 1975, to T. Tyas.

During operation of a needle loom, the needles of the reciprocating needle beam penetrate the non-woven web that is being needled. Since the needles are densely mounted on the needle boards, significant forces are generated by the penetration of the needles into the web, which forces are resisted by the needle beam. These forces cause the needle beam to deflect slightly between and beyond the positions at which the connecting rods are mounted on the needle beam, resulting in a gull-wing-like curvature of the needle beam. Since the guide posts of the guide system which confines the reciprocating motion of the needle beam to rectilinear motion are mounted on the needle beam, either between the connecting rods or outside the connecting rods, an angular displacement of the guide posts occurs due to the deflection of the beam under load. This displacement is due to the fact that the guide posts remain perpendicular to the surface of the beam and, consequently, they lean toward their associated connecting rods and skew in their associated guide bushings.

This skewing action causes very heavy loads to occur on both the guide posts and the guide bushings of the guide system, creating excessive heat and requiring some form of lubricant to keep the heat generated under control. Since lubricants depend on seals to be contained, the prior systems have only been as good as the sealing arrangements employed to contain the lubricants in the guide bushings. However, these arrangements have been far from satisfactory, allowing contamination of the needled web due to lubricant leaking after only a relatively short service life. Moreover, since prior art forms of needle beam guide systems have involved the reciprocation of relatively massive guide posts in connection with maintaining rectilinear motion of the needle beams, the needling speeds that have been achievable in the past have been limited.

It is, therefore, a primary object of the present invention to provide an improved needle beam guide system in which the slide bushings are pivotally mounted to their supports in order to allow them to remain aligned with the guide posts under all operating conditions of the needle beam.

Another object of the present invention is to fix the guide posts of the guide system to the frame of the needle loom and to mount the guide bushings of the guide system on the reciprocating needle beam in order to reduce the mass that has to be moved during reciprocation of the needle beam.

Yet another object of the present invention is to resiliently mount the guide bushings inside the bushing housings so as to allow small movements to occur therebetween in order to absorb shock and some of the misalignment inherent in the operation of needle beams.

Further objects and advantages of this invention will become apparent as the following description proceeds.

SUMMARY OF THE INVENTION

Briefly stated, and in accordance with one embodiment of this invention, an improved needle loom comprises a frame; a needle beam; means, including a drive shaft and a crank means carried by the drive shaft and coupled to the needle beam, for reciprocating the needle beam relative to the frame; and, means, including a guide means fixedly carried by one of the frame and the needle beam and a slide means pivotally carried by the other of the frame and the needle beam and slidable relative to the guide means, for guiding the needle beam during its reciprocating movement relative to the frame.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

DETAILED DESCRIPTION OF THE INVENTION

Figure 1:
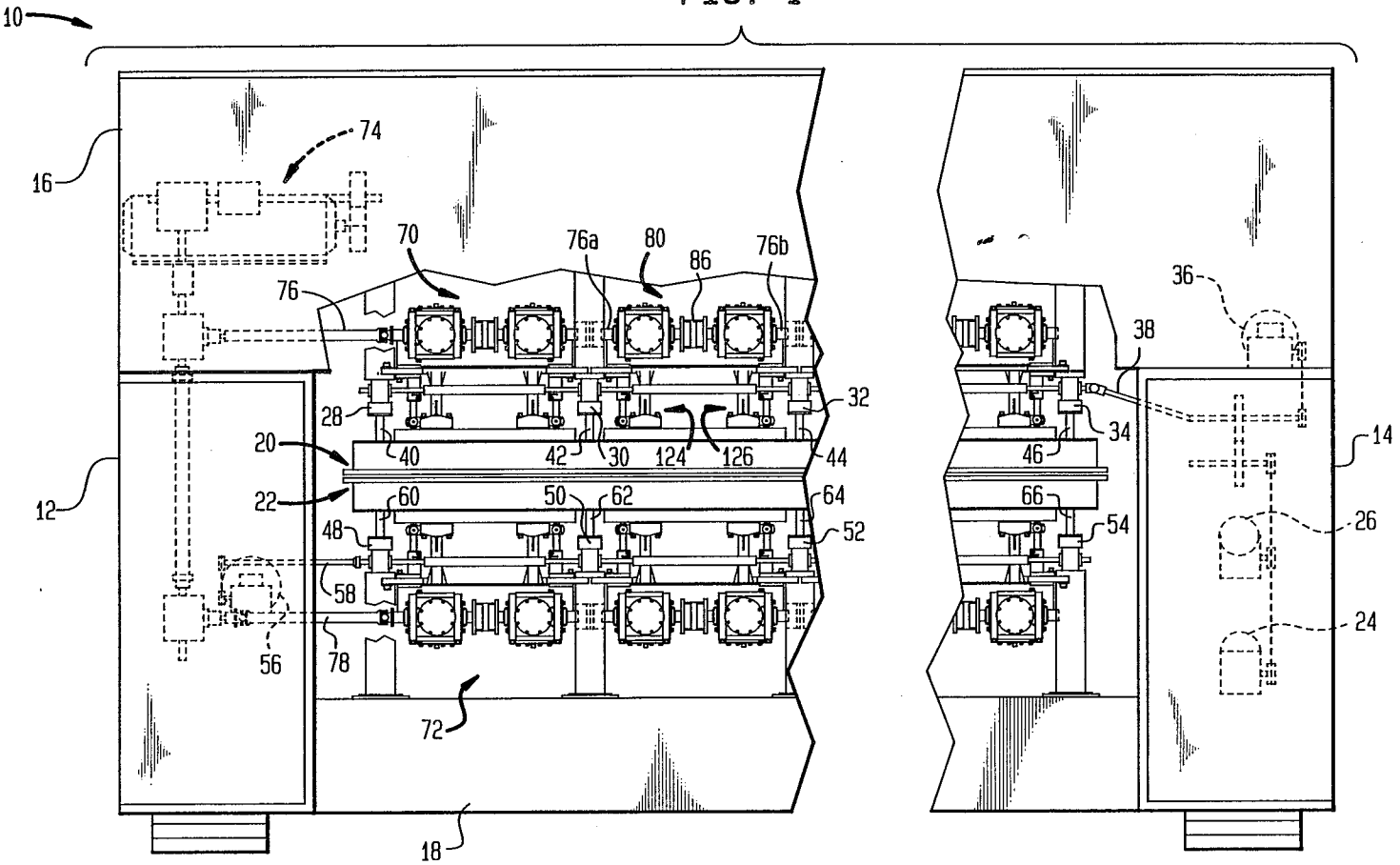
FIG. 1 is a side elevation view, with parts broken away and omitted for clarity, of a needle loom in accordance with this invention.

Referring to FIG. 1, a high speed needle loom having needle beam guide systems in acccordance with the present invention has been illustrated therein generally at 10. The loom 10 includes a left-hand side frame member 12, a right-hand side frame member 14, a top frame member 16 and a bottom frame member 18, which members are fastened to one another to provide a rigid supporting framework for the remaining parts of the loom.

The invention has been illustrated in connection with a duplex type of needle loom in which needling of the non-woven fabric occurs concurrently from both above and below the fabric being processed. However, it will be apparent from the following description that the invention is equally applicable to needle looms in which the non-woven fabric is needled from only one side of the fabric.

In the case of the illustrative embodiment of FIG. 1 the duplex loom includes upper and lower needling plates, shown generally at 20 and 22, respectively. Non-woven fabric to be needled is fed via feed rolls (not shown) that are driven by a feed roll drive motor 24, from a point above the plane of the drawing of FIG. 1, through the plane of the drawing between the upper and lower needling plates 20 and 22, about a draw roll (not shown) that is driven by a draw roll drive motor 26, and is wrapped about a wrap roll (not shown).

The upper needling plate 20 is supported by top frame member 16 via a plurality of screw jack assemblies, four of which are shown at 28, 30, 32 and 34. The screw jack assemblies 28-34 are gang-driven by an upper needling plate drive motor 36 and a drive train that includes a drive shaft 38. Upon rotation of motor 36, worm gears (not shown) at each of the screw jacks 28-34 are rotated by shaft 38. This causes respective lead screws 40, 42, 44 and 46 of screw jack assemblies 28, 30, 32 and 34 to retract into or extend from the various jacks, depending on the direction of rotation of the motor, raising or lowering the upper needling plate 20.

A similar arrangement is provided with respect to the lower needling plate 22. Thus, screw jack assemblies 48, 50, 52 and 54, which are supported by the bottom frame member 18 and in turn support the lower needling plate 22, are gang-driven by a lower needling plate drive motor 56 and an associated drive train that includes a drive shaft 58. Rotation of the drive motor 56 causes worm screws (not shown) associated with each of the screw jacks 48-54 to extend or retract respective lead screws 60, 62, 64 and 66 of the jacks 48, 50, 52 and 54, causing the lower needling plate 22 to raise or lower depending on the direction of rotation of motor 56.

The loom 10 includes a plurality of upper needling modules, shown generally at 70, and a plurality of lower needling modules, shown generally at 72. The upper and lower needling modules 70 and 72 are driven by a needle beam drive motor, shown generally at 74, and drive trains connected thereto which include an upper drive shaft 76 and a lower drive shaft 78.

Referring now to FIGS. 2-5, one of the needling modules which make up the plurality of upper needling modules 70 and lower needling modules 72 has been illustrated therein generally at 80. The needling module 80 includes a needle beam 82 having a plurality of needles 84 projecting therefrom which are adapted to engage the non-woven fabric being processed by the needling loom when the needle beam 82 is reciprocated.

Figure 2:
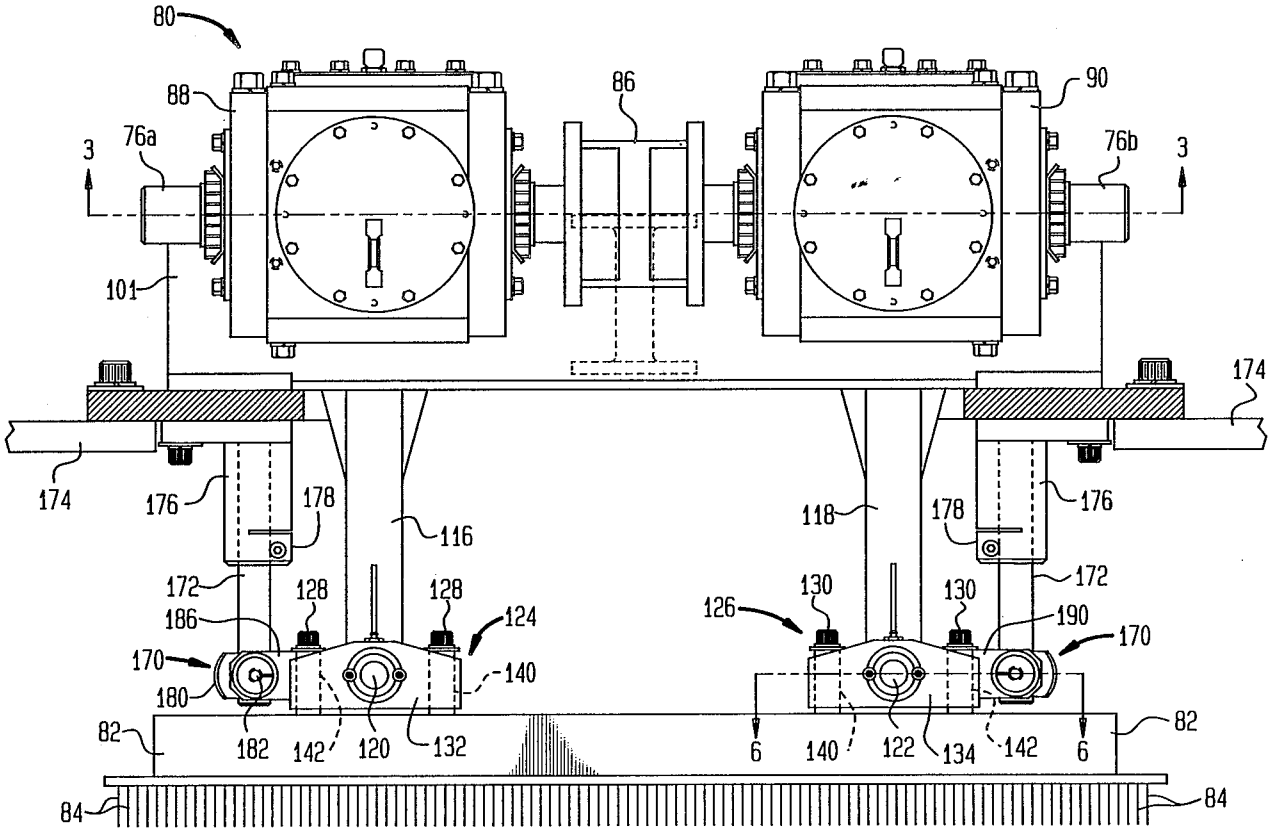
FIG. 2 is a side elevation view, on an enlarged scale, of a needle beam module, showing the drive and guide systems employed in controlling its reciprocating rectilinear movement.
Figure 3:
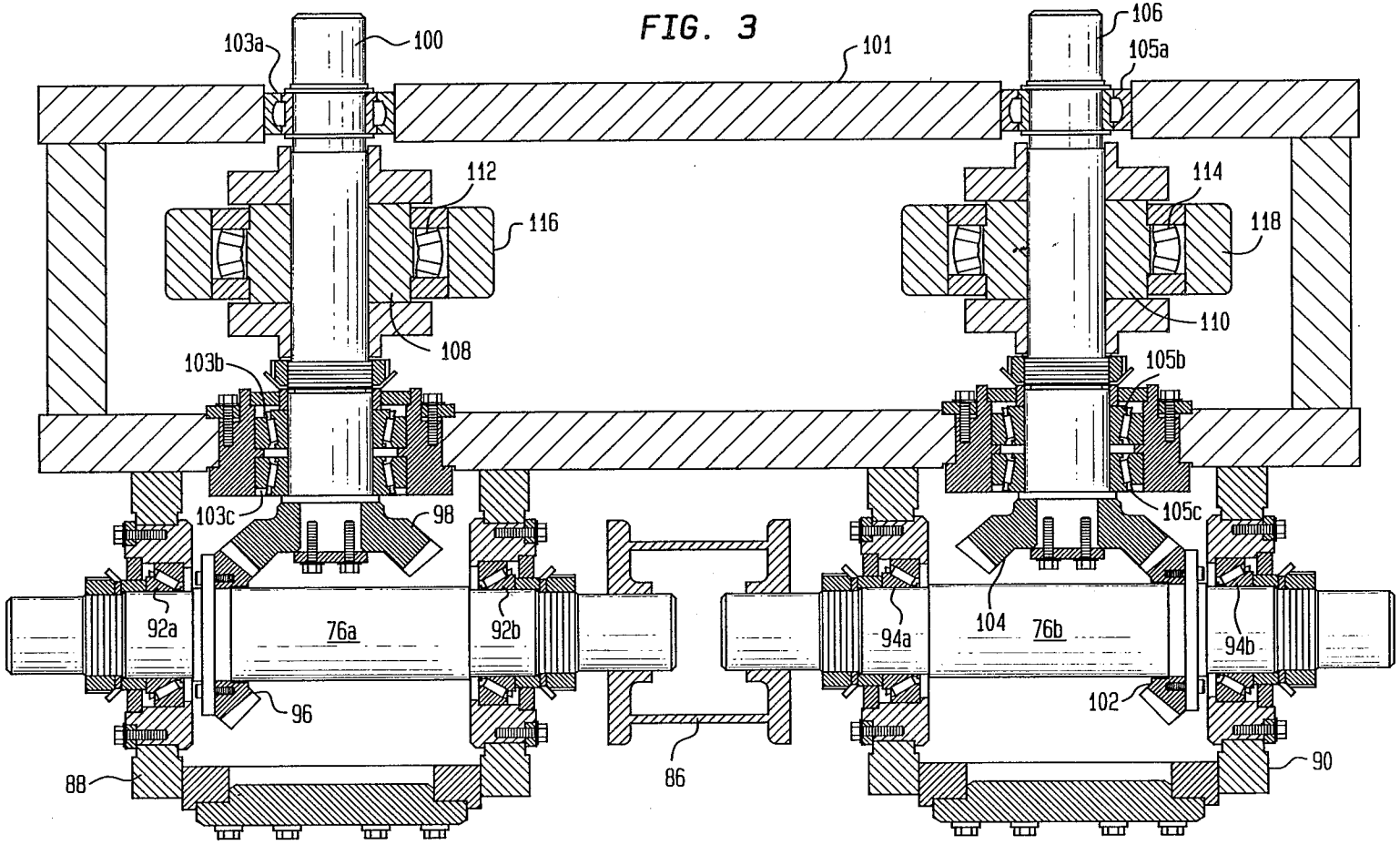
FIG. 3 is an enlarged sectional elevation view, taken along the line 3—3 of FIG. 2.

Needle beam 82 is reciprocated by the aforementioned drive motor 74 (FIG. 1) and drive shaft 76, the various sections 76*a*, 76*b* of which are coupled together by shaft coupling units 86 (FIGS. 2 and 3). Shaft sections 76*a* and 76*b* are supported in respective gear housings 88 and 90 by suitable sets of roller bearings 92*a*, 92*b*, and 94*a*, 94*b*, respectively. Shaft section 76*a* carries a spiral beveled drive gear 96 on it which gear, in turn, drives a driven spiral beveled gear 98 that is geared to an eccentric drive shaft 100 so that rotation of drive shaft section 76*a* causes rotation of the eccentric drive shaft 100. Similarly, drive shaft section 76*b* carries a spiral bevel drive gear 102 along with it and the gear 102, in turn, drives a second spiral bevel driven gear 104 that is fixed to and rotates a second eccentric drive shaft 106. Shafts 100 and 106 are supported in a housing 101 by respective sets of roller bearings 103*a*, 103*b*, 103*c* and 105*a*, 105*b*, 105*c*.

Eccentric cams 108 and 110 are keyed to the respective eccentric drive shafts 100 and 106. The eccentric cams 108 and 110, in turn, are rotatable in respective bearings 112 and 114 that are carried within openings at corresponding first ends of connecting rods 116 and 118 (FIG. 2) which extend between the cams 108 and 110 and needle beam 82. The other corresponding ends of the connecting rods 116 and 118 are journaled on respective shafts 120 and 122 which, in turn, are supported in respective housings, shown generally at 124 and 126. Housings 124 and 126 are fastened to the needle beam 82 by respective bolts 128 and 130.

Figure 6:
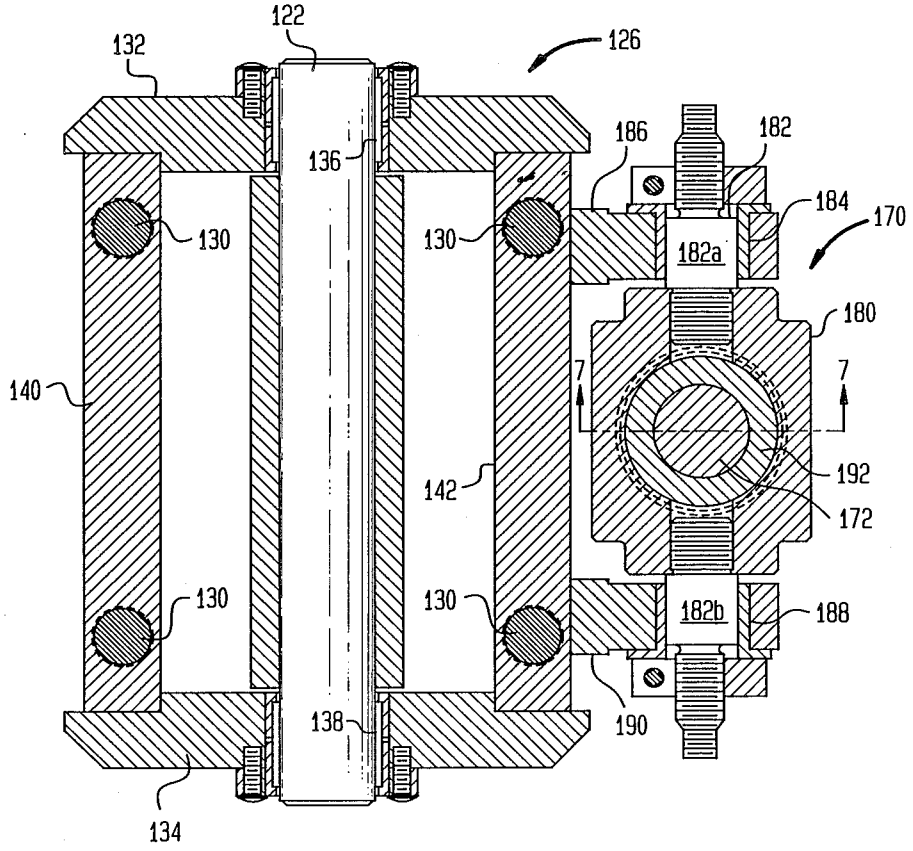
FIG. 6 is a sectional view, taken along the line 6—6 of FIG. 2; and, FIG. 7 is an enlarged sectional perspective view, taken along the line 7—7 of FIG. 6.

Referring more particularly to FIG. 6, wherein the housing 126 has been shown in greater detail, it will be apparent that the shaft 122 is journaled in spaced apart end walls 132 and 134 of housing 126 by means of bearing 136 and 138, respectively. The end walls 132 and 134 are welded or otherwise fastened to side walls 140 and 142 to complete the housing 126. A similar construction is employed in connection with the housing 124, as may be seen in FIG. 2.

Figure 4D:
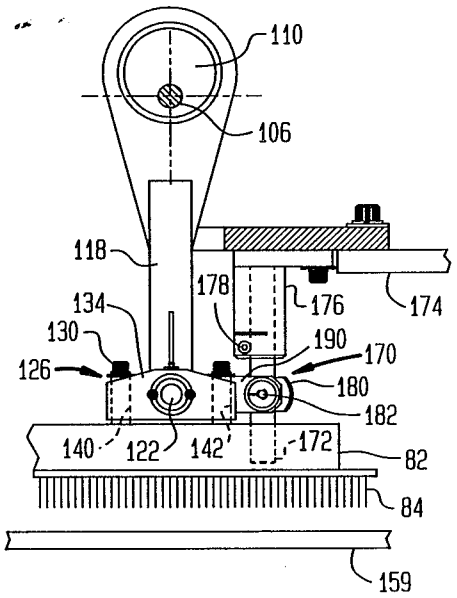
FIGS. 4C and 4D are views similar to FIGS. 4A and 4B, showing needle beam drive and guide systems in accordance with the present invention, with the needle beam being shown in a fabric-engaging position in FIG. 4C and in a non-fabric-engaging position in FIG. 4D.
Figure 4C:
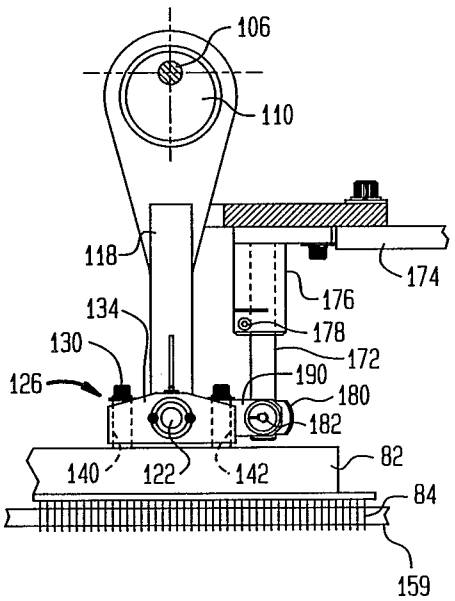
Figure 4A:
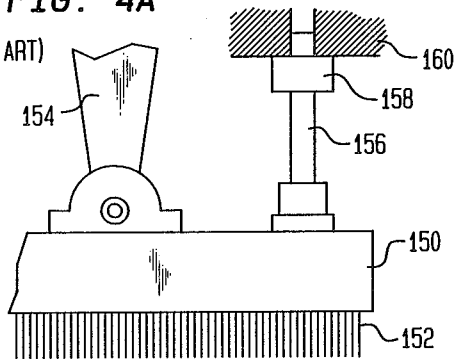
FIG. 4A (PRIOR ART)
FIGS. 4A and 4B show typical prior art drive and guide systems for a needle beam, with the needle beam being shown in an unstressed, elevated position in FIG. 4A and in a stressed, non-woven-web-penetrating position in FIG. 4B.
Figure 4B:
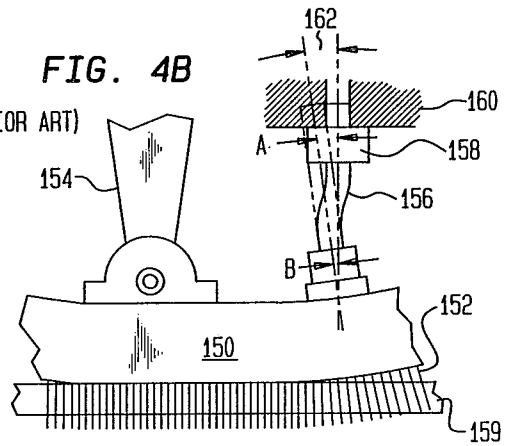
FIG. 4B (PRIOR ART)
Figure 5:
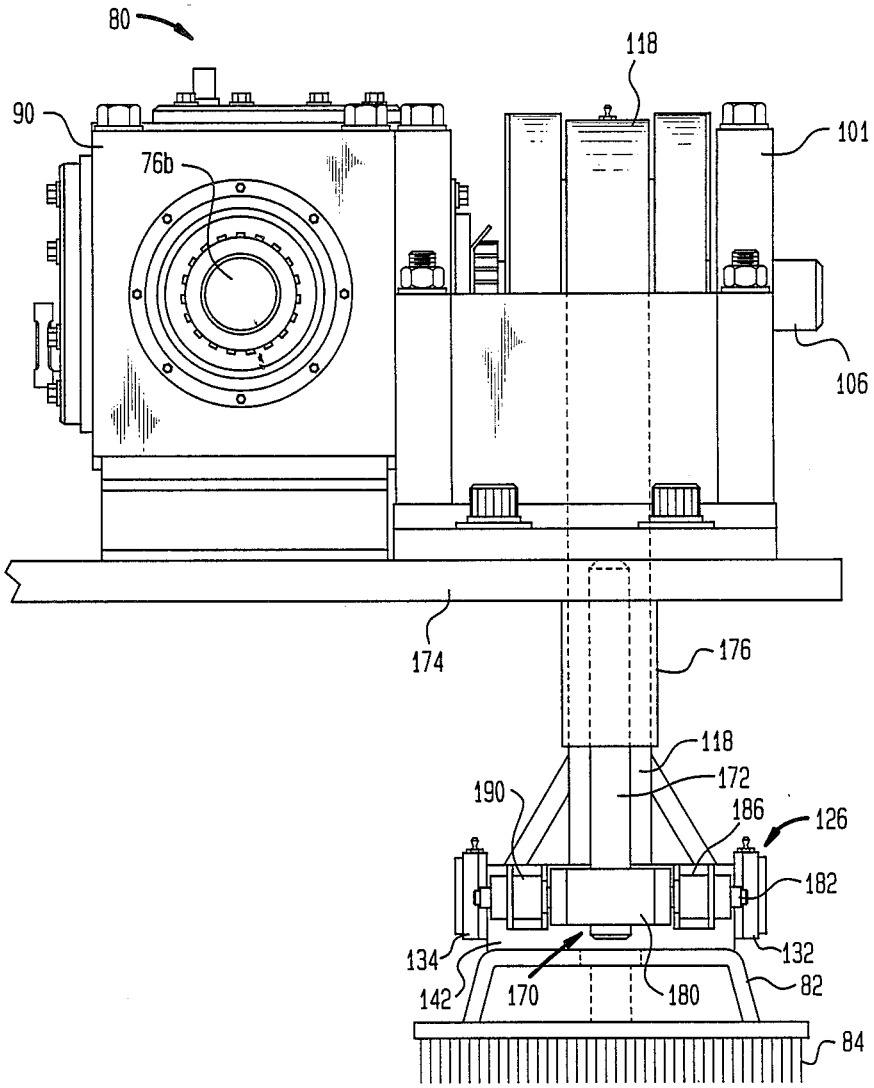
FIG. 5 is an enlarged end elevation view of the needle beam module shown in FIG. 2.

Referring to FIGS. 4A, 4B, 4C and 4D at this time, a brief discussion of prior art forms of needle guide systems will be made with reference to FIGS. 4A and 4B before a detailed discussion is made with respect to the needle beam guide system of the present invention, illustrated in FIGS. 4C and 4D. As shown in FIG. 4A, a needle beam 150 having needles 152 thereon is reciprocated by means of a connecting rod 154. The prior art guide system for beam 150 includes a cylindrical guide post 156 which is rigidly fixed to the upper surface of beam 150 and projects upwardly therefrom into and through a guide bushing 158 that is fixed to the undersurface of the needle loom frame 160. Thus, cylindrical bushing 158 constrains the reciprocation of beam 150 to vertical movement by the sliding engagement existing between the bushing 158 and the guide post 156 which reciprocates vertically within the bushing 158.

As shown in FIG. 4B, misalignment occurs between the guide post 156 and the fixed bushing 158 when the densely mounted needles 152 penetrate a non-woven fabric web 159 in connection with the needling operation. During such penetration, upwardly directed forces are generated which are resisted by the needle beam 150. These forces cause the needle beam to deflect slightly between and beyond the mounting positions of the connecting rods 154 so as to cause the needle beam 150 to take a gull-wing-like shape, as shown in exaggerated form in FIG. 4B. Since the conventional guide post 156 is mounted to the needle beam 150 either between the connecting rods 154 or outside of the connecting rods, an angular displacement of the base of the post relative to the vertical direction occurs, due to deflection of the beam under load. This angular displacement, identified by the arrows at 162 in FIG. 4B, occurs due to the fact that the guide post 156 remains perpendicular to the surface of the beam and, consequently, leans toward the connecting rod during deflection of the beam under load. This causes the post 156 to skew within, and bend with respect to, the guide bushing 158, the axis of which remains vertical at all times. The skewing action causes very heavy side loads to be applied to the guide system, creating excessive heat and resulting in the various disadvantages referred to earlier herein.

In accordance with the present invention, and as illustrated in FIGS. 2, 4C, 4D and 5–7, a slide bushing, shown generally at 170, is provided which is pivotally mounted relative to its supporting structure so that the axis of the cylindrical slide opening therein can remain aligned with the axis of a guide post 172 with which it is slidably engaged. In the preferred embodiment of this invention the guide post 172 is fixedly attached to a frame member 174 by a bracket 176 having an adjustable clamp portion 178 which facilitates vertical positioning of the guide post 172 relative to the bracket 176. Frame member 174, in turn, is fixedly carried by the top frame member 16 (FIG. 1) of the needle loom so that each of the guide posts 172 are fixed in space relative to the frame of loom 10.

Figure 7:
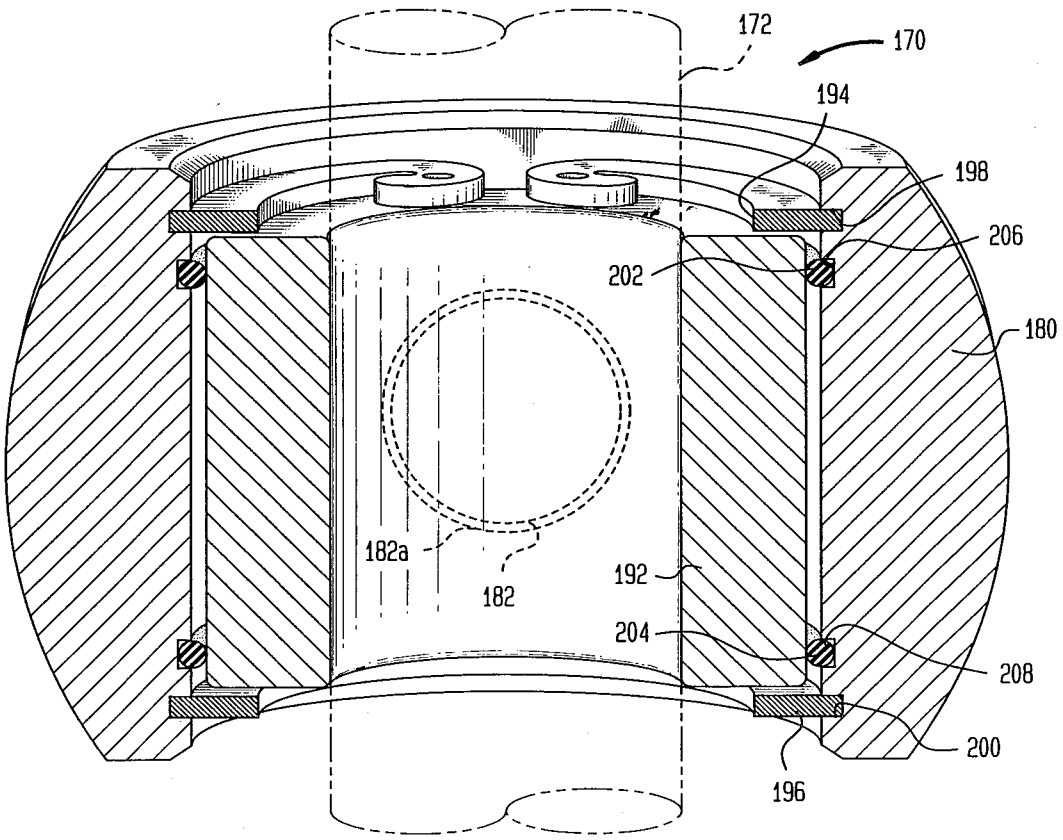

As shown most clearly in FIGS. 6 and 7, the slide bushings 170 include a slide bushing housing 180 that is mounted on a pivotal shaft 182 having shaft sections **182*a* and 182*b* projecting outwardly therefrom. Shaft section 182*a* is journaled in a sleeve bearing 184 carried by a bracket 186 that is welded or otherwise rigidly fastened to the side wall 142 of the housing 126 to which connecting rod 118 is connected. Shaft section 182*b* is journaled in a sleeve bearing 188 carried in a bracket 190 that is also welded or otherwise fixedly carried by the sidewall 142. The arrangement is such that the housing 180 is pivotable relative to the brackets 186 and 190**.

A slide bearing 192 is positioned .within the slide bushing housing 180 and is held in place therein by means of spaced retainer clips 194 and 196 (FIG. 7) that engage with respective groove 198 and 200 formed within the inner periphery of slide bushing housing 180. The spacing between the retainer clips 194 and 196 is slightly greater than the axial length of the slide bearing 192 so that the bearing is capable of limited axial movement therebetween. In addition, the outer diameter of the slide bearing 192 is slightly less than the inner diameter of the slide bushing housing 180, and spaced apart "O"-rings 202, 204, which are mounted in spaced grooves 206, 208 formed on the inner periphery of the slide bushing housing 180, are employed to resiliently, radially center the outer periphery of the slide bearing 192 relative to the inner periphery of the slide bushing housing 180. The inner diameter of the slide bearing 192 is such as to allow the slide bearing to slidingly move upon the guide post 172 during reciprocating movement of the needle beam when the loom is in operation.

Referring to FIG. 2, the construction of the guide system associated with connecting rod 116 and housing 124 and is essentially the same as that described above in connection with connecting rod 118 and housing 116. Accordingly, corresponding parts in that guide system have been identified with the same numerical designations as those indicated above.

From the foregoing description, it will be seen that the construction employed allows the slide bearing 192 to shift slightly within its slide bushing housing 180 so that side thrusts caused by the deflection of the needle beam under load can be compensated for by compression of the O-rings 202, 204. Moreover, it will be seen that pivotal mounting of the slide bushing housing 180 relative to the upper surface of the needle beam 82 allows the housing and its associated bearing to realign with the vertical when the upper surface becomes deflected under load. A combination of the two features, namely shifting to minimize side thrust and realigning to compensate for the skewing of the center line of the slide bearing relative to the vertical center line of the guide post, greatly reduces the forces on the guide post and on the slide bushing, limiting heat build-up and premature breakdown of lubricant sealant systems. In addition, by mounting the guide bushing on the upper surface of the needle beam and the guide post on the lower surface of the loom frame, rather than vice versa, the bushing is positioned closer to the point of beam deflection, minimizing the horizontal displacement of the center line of the guide post from the centerline of the slide bushing that is otherwise encountered due to the angular relationship between the two centerlines when the needle beam is deflecting due to loading, as shown by the differences in length of the dimensions marked "A" and "B" in FIG. 4B.

While a particular embodiment of this invention has been shown and described, it will be apparent to those skilled in the art that various changes and modifications may be made without departing from this invention in its broader aspects. As one example thereof, the slide bushing 170 and its associated parts could be pivotally mounted to the undersurface of the frame 174 of the loom while the guide posts 172 could be rigidly fixed to the upper surface of the needle beam. Such an embodiment, although not achieving the full benefits of the preferred embodiment of the invention, provides compensation for the misalignment of the axes of the guide posts and the slide bearing and provides some compensation for the side thrust generated by the misalignment, notwithstanding that the side thrust is greater when the slide bearing is positioned remote from, rather than adjacent to, the needle beam. Other examples of changes and modifications that may be made without departing from this invention in its broader aspect will be readily apparent to those skilled in the art. It is, therefore, aimed in the appended claims to cover all such changes and modifications as fall within the true spirit and scope of this invention.

What is claimed is:

1. A needle loom, comprising a frame; a needle beam; means, including a drive shaft and a crank means carried by said drive shaft and coupled to said needle beam, for reciprocating said needle beam relative to said frame; and, means, including a guide means fixedly carried by one of said frame and said needle beam and a slide means pivotally carried by the other of said frame and said needle beam and slidable relative to said guide means, for guiding said needle beam during reciprocating movement of the latter relative to said frame.

2. A needle loom according to claim 1, wherein said guide means is fixedly carried by said frame and wherein said slide means is pivotally carried by said needle beam.

3. A needle loom according to claim 2, wherein said slide means includes at least one slide bushing, and wherein said guide means includes at least one guide post slidingly engaged by said slide bushing.

4. A needle loom according to claim 3, wherein said slide bushing includes a slide bearing and a slide housing supporting said slide bearing therein for limited movement relative to said housing, said slide bushing further including resilient means interposed between said slide bearing and said slide housing for normally positioning said slide bearing in a centered position within said slide housing but allowing said bearing to shift within said housing when misalignment forces are applied thereto.

5. A needle loom according to any one of claims 3 or 4, wherein said needle beam is generally rectangular in plan and includes an elongate first dimension and a shorter second dimension, wherein said slide means comprises first and second slide bushings pivotally carried by said needle beam adjacent corresponding opposite ends of the long dimension thereof, and wherein said guide means comprises corresponding first and second guide posts aligned with and slidingly engaged by said first and second slide bushings.

6. A needle loom according to claim 5 wherein said first and second slide bushings are pivotable about respective axes that are parallel to said second dimension, wherein said needle beam includes an upper surface thereon, and wherein said axes are positioned adjacent to said upper surface of said needle beam.

7. A needle loom according to claim 6, wherein said crank means includes first and second connecting rods spaced from one another along said first dimension, said connecting rods being journaled on said drive shaft at corresponding ones of their ends and being journaled on said needle beam at corresponding others of their ends for oscillation about axes that are co-planar with and parallel to said axes of said slide bushings.

* * * * *